US010912713B2

(12) United States Patent
Yago et al.

(10) Patent No.: US 10,912,713 B2
(45) Date of Patent: Feb. 9, 2021

(54) SELF-STANDING DRUG-FILLED SYNTHETIC RESIN AMPULE

(71) Applicant: TERUMO KABUSHIKI KAISHA, Tokyo (JP)

(72) Inventors: Seiji Yago, Sagamihara (JP); Chisato Iwakiri, Hiratsuka (JP); Naomi Harada, Hadano (JP)

(73) Assignee: TERUMO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/020,249

(22) Filed: Jun. 27, 2018

(65) Prior Publication Data

US 2018/0303710 A1 Oct. 25, 2018

Related U.S. Application Data

(63) Continuation of application No. PCT/JP2016/088719, filed on Dec. 26, 2016.

(30) Foreign Application Priority Data

Dec. 28, 2015 (JP) ..... 2015-256887

(51) Int. Cl.
*A61J 1/06* (2006.01)
*B65D 1/09* (2006.01)
(Continued)

(52) U.S. Cl.
CPC ..... *A61J 1/06* (2013.01); *A61J 1/065* (2013.01); *A61J 1/067* (2013.01); *A61J 1/16* (2013.01);
(Continued)

(58) Field of Classification Search
CPC ... A61J 1/067; A61J 1/06; A61J 1/065; B65D 1/09; B65D 1/095; B65D 2207/00
(Continued)

(56) References Cited

U.S. PATENT DOCUMENTS 3,917,120 A * 11/1975 Larenz ..... B65D 75/48 222/129
6,619,516 B2 * 9/2003 Weiler ..... B65D 1/0238 222/420
6,827,227 B2 * 12/2004 Fontana ..... B65D 47/36 215/250
(Continued)

FOREIGN PATENT DOCUMENTS

DE 19648820 A1 5/1998
JP JP-S59-169832 U 11/1984
(Continued)

OTHER PUBLICATIONS

International Searching Authority, "Written Opinion", issued in connection with International Patent Application No. PCT/JP2016/088719, dated Mar. 21, 2017.
(Continued)

*Primary Examiner* — Steven A. Reynolds
(74) *Attorney, Agent, or Firm* — Foley & Lardner LLP

(57) ABSTRACT

A drug-filled synthetic resin ampule has an ampule body capable of standing by itself and a drug accommodated inside the ampule body. The ampule body has a tip part positioned at an upper part thereof when the ampule body stands by itself, a hollow part having a drug accommodation portion, and a breakable part provided between a lower portion of the tip part and an upper portion of the hollow part. The tip part has pressing portions, for guiding a pressing force applied thereto respectively in a predetermined direction when an operation of breaking the breakable part is performed. The hollow part has a bottom surface part for allowing the ampule body to stand by itself. The bottom surface part has extension portions extended in predetermined directions (X-direction, Y-direction) in which the pressing force applied to the pressing portions respectively is guided when the operation of pressing the pressing portion is performed to break the breakable part.

15 Claims, 12 Drawing Sheets

(51) Int. Cl.
*A61J 1/16* (2006.01)
*B65D 8/00* (2006.01)

(52) U.S. Cl.
CPC ..... *B65D 1/09* (2013.01); *B65D 1/095* (2013.01); *B65D 11/02* (2013.01); *B65D 2207/00* (2013.01)

(58) Field of Classification Search
USPC ..... 206/530; 604/403
See application file for complete search history.

(56) References Cited

U.S. PATENT DOCUMENTS

| | | | | |
|---|---|---|---|---|
| 8,833,576 | B2 * | 9/2014 | Fontana | A61J 1/067 206/530 |
| 2010/0010434 | A1 | 1/2010 | Oyama | |
| 2011/0100861 | A1 * | 5/2011 | Manabe | A61J 1/067 206/524.6 |
| 2016/0151240 | A1 * | 6/2016 | Brandenburger | B29C 45/14 604/403 |

FOREIGN PATENT DOCUMENTS

| | | | |
|---|---|---|---|
| JP | H08-322908 | A | 12/1996 |
| JP | 2013-095436 | A | 5/2013 |
| JP | 2013-230253 | A | 11/2013 |
| JP | 2014-069856 | A | 4/2014 |
| JP | 5802605 | B2 | 10/2015 |
| WO | WO-2007/141813 | A1 | 12/2007 |
| WO | WO-2008/056442 | A1 | 5/2008 |

OTHER PUBLICATIONS

Extended European Search Report issued in the corresponding EP Application Serial No. 16881727.8, dated Aug. 12, 2019.
International Search Report with English language translation and Written Opinion issued in International Application No. PCT/JP2016/088719 dated Mar. 21, 2017.
Office Action dated Aug. 24, 2020 in corresponding Indian Patent Application No. 201817026454.

* cited by examiner

SELF-STANDING DRUG-FILLED SYNTHETIC RESIN AMPULE

CROSS-REFERENCE TO RELATED APPLICATIONS

The present application is a bypass continuation of PCT Application No. PCT/JP2016/088719, filed on Dec. 26, 2016, which claims priority to Japanese Patent Application No. 2015-256887, filed on Dec. 28, 2015. The contents of these applications are hereby incorporated by reference in their entireties.

TECHNICAL FIELD

The present invention relates to a drug-filled synthetic resin ampule which can be opened by performing a breaking operation.

BACKGROUND ART

In recent years, as containers such as an ampule accommodating a liquid medicine, a synthetic resin ampule has come to be used instead of a glass container from the standpoint of safety in the use of the synthetic resin ampule against damage when it falls down, injury to an operator when it is opened, and generation of fragments, and easy handle ability.

A synthetic resin ampule is disclosed in Japanese Patent Application Laid-Open Publication No. 2013-095436 (patent document 1). In the plastic ampule 1 of the patent document 1 having the ampule body 3 where the spout 8 is formed, the plug part 5 connected communicably to the ampule body 3 through the intermediary of the neck part 4 formed along the spout 8, and the head part 7 connected to the plug part 5 through the intermediary of the thin plate-shaped edge part 6 projecting outward from the plug part 5, the arm plate 15 flat in the direction intersecting with the edge part 6 is formed at the head part 7. By pulling up the arm plate 15 with the arm plate 15 being pinched with fingers, the portion between the ampule body 3 and the head part 7 is bent with the neck part 4 as a fulcrum so as to snap the neck part 4. Thereby the plastic ampule is opened.

A synthetic resin ampule is disclosed in Japanese Patent Application Laid-Open Publication No. 2014-69856 (patent document 2). The synthetic resin ampule of the patent document 2 has the body part (1), having a bottomed tubular configuration made by means of biaxial stretching blow molding, which accommodates the content liquid (N), the topped tubular head part (6) formed erectly and continuously with the upper end of the body part (1), the weakening part (10) which is formed at the boundary between the body part (1) and the head part (6) and to be broken by a relative fluctuation between the body part (1) and the head part (6). In this construction, a large number of vertical ribs (9) are circumferentially arranged in parallel with one another at the inner circumferential surface portion (7) to which the peripheral edge of the lower-end liquid surface (n1) of the remaining content liquid (N) positioned inside the head part (6) attaches to form the irregular surface portion (8) by disposing the vertical ribs (9) whose heights are different from one another at the upper ends mixedly with the irregular surface portion (8).

PRIOR ART DOCUMENTS

Patent Documents

Patent document 1: Japanese Patent Application Laid-Open Publication No. 2013-095436

Patent document 2: Japanese Patent Application Laid-Open Publication No. 2014-69856

SUMMARY OF THE INVENTION

Problems to be Solved by the Invention

Because the synthetic resin ampules of the patent documents 1 and 2, it is possible to prevent the ampules from being damaged when they fall over and easy to handle them.

But the ampules of the patent documents 1 and 2 have poor stability and thus it is not easy to perform an operation of opening them.

Therefore, it is an object of the present invention to provide a drug-filled synthetic resin ampule, which is capable of standing by itself and allows an opening operation to be easily performed with the ampule standing by itself.

Means for Solving the Problems

The above-described object can be achieved by the following form.

A drug-filled synthetic resin ampule comprises an ampule body capable of standing by itself and a drug accommodated inside said ampule body, wherein said ampule body has a tip part positioned at an upper part thereof when the ampule body stands by itself, a hollow part having a drug accommodation portion, and a breakable part provided between a lower portion of said tip part and an upper portion of said hollow part; and said tip part has a pressing portion for guiding a pressing force applied thereto in a predetermined direction when an operation of breaking said breakable part is performed; said hollow part has a bottom surface part for allowing said ampule body to stand by itself; and said bottom surface part has an extension portion extended in said predetermined direction.

MODE FOR CARRYING OUT THE INVENTION

Figure 1:
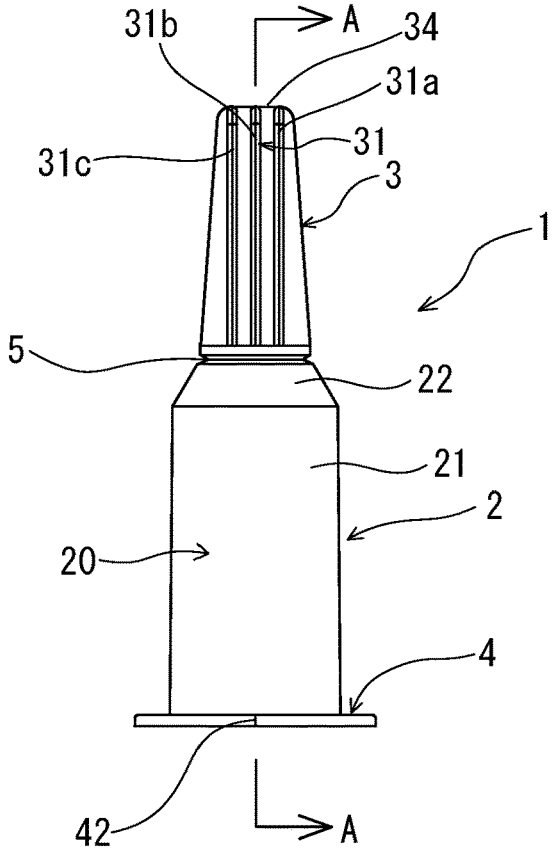
FIG. 1 is a front view of a drug-filled synthetic resin ampule of one embodiment of the present invention.

The embodiments of the present invention are described in detail below with reference to the accompanying drawings.

A drug-filled synthetic resin ampule 1 of the present invention has an ampule body 2 capable of standing by itself and a drug 6 accommodated inside the ampule body 2. The ampule body 2 has a tip part 3 positioned at an upper part thereof when the ampule body stands by itself, a hollow part 21 having a drug accommodation portion 23, and a breakable part 5 provided between a lower portion of the tip part 3 and an upper portion of the hollow part 21. The tip part 3 has pressing portions 31, 32 for guiding a pressing force applied thereto in a predetermined direction when an operation of breaking the breakable part 5 is performed. The hollow part 21 has a bottom surface part 4 for allowing the ampule body to stand by itself. The bottom surface part 4 has extension portions 41, 42 extended in predetermined directions (X-direction, Y-direction) in which the pressing force applied to the pressing portions 31, 32 is guided when an operation of pressing the pressing portions 31, 32 is performed to break the breakable part.

As shown in FIGS. 1 through 4, the drug-filled synthetic resin ampule 1, of the present invention has the ampule body 2 capable of standing by itself and the drug 6 accommodated inside the ampule body 2.

As shown in FIGS. 1 through 4, the ampule body 2 has the tip part 3 positioned at the upper part thereof when the ampule body stands by itself, the hollow part 21 having the drug accommodation portion 23, and the breakable part 5 provided between the lower portion of the tip part 3 and the upper portion of the hollow part 21. In the ampule 1 of this embodiment, the ampule body 2 capable of standing by itself has a tubular body 20 and a bottom plate member 40 sealing a lower-end opening of the tubular body 20. The tubular body 20 has the hollow part 21, the tip part 3, and the breakable part 5.

Figure 4:
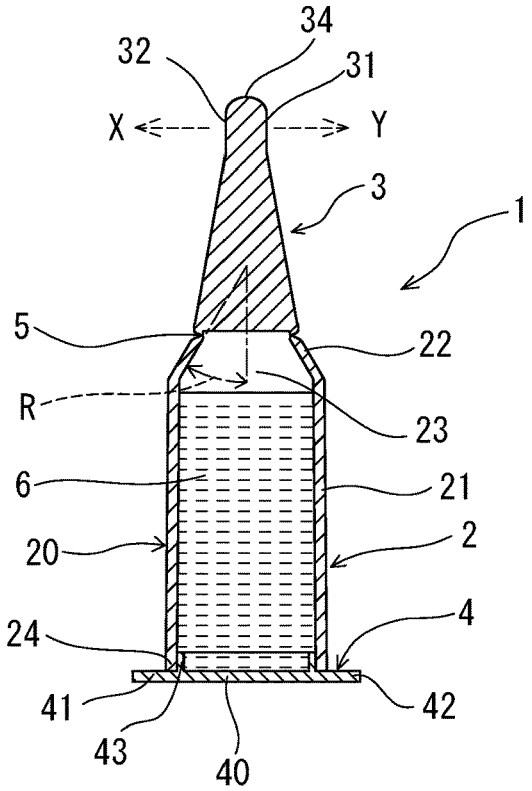
FIG. 4 is a sectional view taken along a line A-A of FIG. 1.

The tubular body 20 has the lower-end opening and includes the hollow part 21 extended upward, the tip part 3 positioned upward from the hollow part, and the breakable part 5 provided between the lower portion of the tip part 3 and the upper portion of the hollow part 21, in other words, so provided as to form a boundary portion between the tip part 3 and the hollow part 21. The hollow part 21 has the drug accommodation portion 23. It is preferable that the volume of the drug accommodation portion 23 is 0.5 to 50 ml. As shown in FIG. 4, the hollow part 21 has a cylindrical portion extended a predetermined length in substantially the same outer and inner diameters and an inner-surface tapered portion 22 positioned upward from the cylindrical portion. Thus, in the ampule 1 of this embodiment, the hollow part 21 has the inner-surface tapered portion 22 whose diameter decreases toward the breakable part 5. The tapered portion 22 may be formed by upward decreasing the diameters of the inner and outer surfaces thereof.

The tubular body 20 can be formed by injection molding. For example, the tubular body including the hollow material 21 is formed by injection molding, thereafter the breakable material 5 may be attached to the formed tubular body by ultrasonic welding or high frequency welding. Further, the entire tubular body 20 including the breakable material 5 may be formed by injection molding. It is also possible to form the bottom surface part 4 by forming the bottom surface part 4 integrally with the tubular body 20 or with the tubular body including the hollow part 21. Furthermore, as with the breakable part 5, the bottom surface part 4 may be mounted on the formed tubular body 20 by ultrasonic welding or high frequency welding.

The inner diameter of the cylindrical portion is preferably 6 to 33 mm and especially preferably 7 to 24 mm. The outer diameter of the cylindrical portion is preferably 7 to 35 mm and especially preferably 10 to 25 mm. The inner diameter of the tapered portion 22 is preferably 3 to 12 mm and especially preferably 3 to 9 mm at a small-diameter portion thereof.

It is preferable to form the hollow part (drug accommodation portion 23) of the tubular body 20 transparently to allow the drug accommodated therein to be visible. Although the pressure inside the drug accommodation portion 23 of the tubular body 20 may be set normally, the pressure therein may be set to a decreased pressure state or a vacuum state. In a case where the pressure inside the drug accommodation portion is set to the decreased pressure state or the vacuum state, it is possible to increase the effect of preventing the drug from altering, decomposing and deteriorating.

The drug 6 to be accommodated inside the drug accommodation portion includes any kind including a solid-state drug, for example, powdery, granular and a liquid-state drug. Examples of the drug include analgesic agents such as morphine (narcotic analgesic agents), insulin, antitumor agents, cardiotonic agents, intravenous anesthetic agents, antiparkinson agents, tumor therapeutic agents, adrenocortical hormone agents, antiarrhythmic agents, correction electrolytes, antiviral agents, immunostimulant agents, antibiotics, local anesthetic agents such as xylocaine, vitamins, multivitamin preparations, various amino acids, anti-thrombotic agents such as heparin. Drugs such as the narcotic analgesic agents and the antitumor agents needed to be handled and managed with care are preferable as the drug to be accommodated inside the drug accommodation portion.

The breakable part 5 is a thin and fragile part provided in the vicinity of the boundary portion between the drug accommodation portion 23 and the tip part 3. In this embodiment, the thin and fragile part (breakable part) is formed of an annular groove formed on an outer surface of the tubular body 20. More specifically, the thin and fragile part is formed on the outer surface of an upper-end portion of the tapered portion 22 of the tubular body 20. By bending the tip part 3 with respect to the tubular body 20, the breakable part 5 is broken. As a result, the drug accommodation portion 23 is opened. A groove-formed portion is V-shaped in its sectional configuration. More specifically, the angle of the groove-formed portion in its section is preferably 30 to 90 degrees and especially preferably 40 to 50 degrees. The groove-formed portion having an angle in the above-described range allows a stress to concentrate on the center of the breakable part when the tip part 3 is bent. Thereby the breakable part is securely broken.

The groove-formed portion may be formed in any configuration so long as its configuration is easily breakable. In addition to the V-shaped configuration of the groove-formed portion adopted in the embodiment, its configuration may be semicircular, semi-elliptic or the like. The groove-formed portion may be so formed that its thickness is relatively smaller than that of the neighborhood thereof to easily break the groove-formed portion. In addition, the breakable part may be formed of a material more fragile than that of other portions of the tubular body. More specifically, it is preferable to use multicolor molding to annularly form only the neighborhood of the breakable part of a material which can be easily broken. Other portions of the tubular body are made of a material which cannot be easily broken. Although in the embodiment of the present invention, the groove-formed portion is formed annularly and continuously on the entire outer circumference of the drug accommodation portion, the groove-formed portion may be intermittently formed on the entire outer circumference thereof.

It is possible to chamfer an edge of the annular groove-formed portion which forms the breakable part 5 at the side of the above-described tapered portion and an edge of the annular groove-formed portion at the side of the tip part. More specifically, it is possible to round an outer edge of the annular groove-formed portion at the side of the tapered portion and an outer edge of the tip part.

The tip part 3 forms the upper part of the ampule body 2 and is positioned at an upper part of the tubular body 20. The tip part 3 has the pressing portions 31, 32 for guiding the pressing force applied thereto in the predetermined direction when the operation of breaking the breakable part 5 is performed. In the ampule 1 of the present invention, the hollow part 21 has the bottom surface part 4 for allowing the ampule body to stand by itself.

The bottom surface part 4 allows the ampule 1 to stand by itself with the upper portion of the hollow part facing upward and with the front end of the tip part 3 also facing upward. It is preferable that the ampule 1 stands by itself without staggering. But the ampule may swing or tilt to some extent. In a case where the ampule swings or tilts, it is preferable that the ampule is to swing or tilt in the first predetermined direction (X direction) for breaking operation of a breakable portion 5 or a direction (Y-direction) opposite to the first predetermined direction.

In this embodiment, the bottom surface part 4 is substantially flat and thus, the synthetic resin ampule 1 is allowed to stand by itself without staggering with the tip part 3 being substantially erect. Although it is preferable that almost the entire bottom surface part 4 is formed flatly, the central portion thereof may be hollow. In addition, the bottom surface part may have an annular projected portion for allowing the ampule to stand by itself.

In the ampule 1 of the embodiment shown in FIGS. 1 through 4, the tip part 3 has the first pressing portion 31 for performing the operation of breaking the breakable part 5 and guiding the pressing force applied thereto in the first predetermined direction (X-direction), and a second pressing portion 32 for performing the operation of breaking the breakable part 5 and guiding the pressing force applied thereto in the direction (Y-direction) opposite to the first predetermined direction. The bottom surface part 4 has the extension portion 41 extended in the predetermined direction (X-direction) in which the pressing force applied to the pressing portion 31 is guided when the operation of pressing the pressing portion 31 is performed to break breakable part. In addition, the bottom surface part 4 has the extension portion 42 extended in the predetermined direction (Y-direction) in which the pressing force applied to the pressing portion 32 is guided when the operation of pressing the pressing portion 32 is performed to break breakable part.

In the ampule 1 of this embodiment, as shown in FIG. 4, the ampule body 2 does not have a drug-storable portion, which is a general configuration of a glass ampule, in an upper portion than said breakable part including said tip part. Thus, it does not occur that the drug (liquid medicine in particular) scatters when the breakable part is broken and remains at the side of the broken tip part. In this embodiment, the tip part 3 is solid. The tip part does not necessarily need to be perfectly solid but may have an occluded lumen therein. In this embodiment, the breakable part 5 is formed of the groove formed on the outer surface of the tubular body, as described above and does not constitute an inwardly projected portion. Thus, the ampule body does not have a drug storage portion although the ampule body has the breakable part.

In the ampule 1 of this embodiment, the tip part 3 has a plate-shaped body portion 34 and a plurality of ribs formed on both surfaces of the plate-shaped body portion 34 by extending the ribs axially with the ribs being vertical to the plate-shaped body portion. Ribs 31*a*, 31*b*, and 31*c* are formed at the side of the first pressing portion 31 by extending the ribs axially (upward and downward direction). There is formed on the upper portion of the tip part 3 the first pressing portion 31 for performing the operation of breaking the breakable part 5 and guiding the pressing force applied thereto in the first predetermined direction (X-direction).

Figure 2:
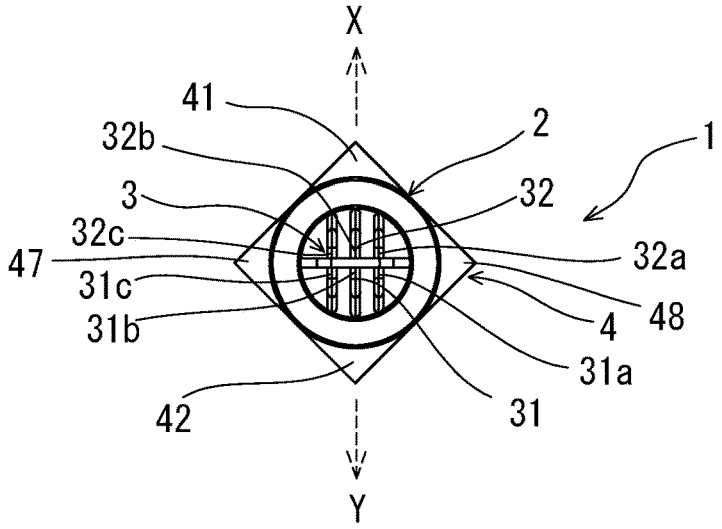
FIG. 2 is a plan view of the drug-filled synthetic resin ampule of FIG. 1.

More specifically, as shown in FIGS. 1 and 2, the first pressing portion 31 is formed of upper portions of the ribs 31*a*, 31*b*, and 31*c* formed on an outer surface of the plate-shaped body portion 34 by axially (upward and downward direction) extending them. The upper portions of the ribs 31*a*, 31*b*, and 31*c* are projected from the plate-shaped body portion 34 in substantially the same height. Thus, the first pressing portion can be favorably pressed with fingers. The pressing direction is orthogonal to a surface (imaginary plane) formed of the first pressing portion 31. The pressing direction is referred to as the first predetermined direction (X-direction). Therefore, by pressing the first pressing portion 31 with fingers or the like, the tip part 3 is pressed in the X-direction. Thereby the breakable part 5 starts to be broken below the first pressing portion 31. With the progress of the breakage, the tip part 3 falls over in the X-direction.

Figure 3:
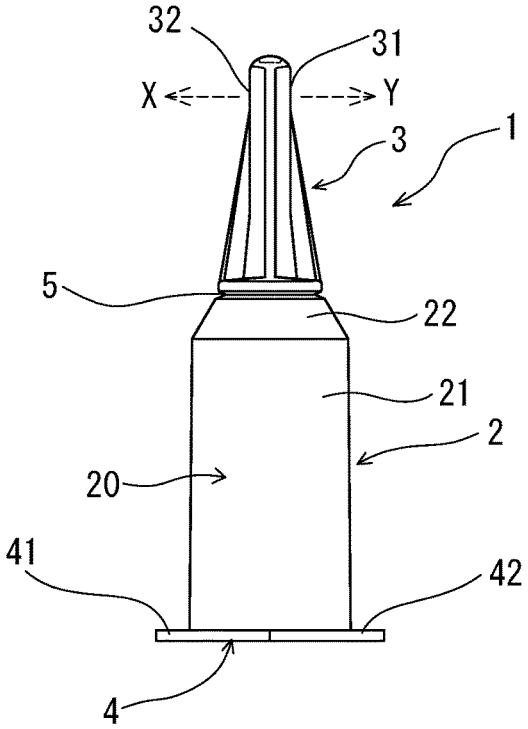
FIG. 3 is a left-side view of the drug-filled synthetic resin ampule of FIG. 1.

As shown in FIGS. 2 through 4, the ribs 31*a*, 31*b*, and 31*c* extend downward from the pressing portion 31, and the protruding lengths increase downward. The rib reinforces the whole of the tip portion 3.

There is formed on the upper portion of the tip part 3 the second pressing portion 32 for performing the operation of breaking the breakable part 5 and guiding the pressing force applied thereto in the second predetermined direction (Y-direction). In the ampule 1 of this embodiment, as with the first pressing portion, ribs 32*a*, 32*b*, and 32*c* are formed at the side of the second pressing portion 32 by extending the ribs axially (upward and downward direction).

As shown in FIG. 2, the second pressing portion 32 is formed of upper portions of the ribs 32*a*, 32*b*, and 32*c* formed on the outer surface of the plate-shaped body portion 34 by axially (upward and downward direction) extending them. The upper portions of the ribs 32*a*, 32*b*, and 32*c* are projected from the plate-shaped body portion 34 in substantially the same height. Thus, the second pressing portion can be favorably pressed with fingers. The pressing direction is orthogonal to a surface (imaginary plane) formed of the second pressing portion 32. The pressing direction is referred to as the second predetermined direction (Y-direction). Therefore, by pressing the second pressing portion 32 with fingers or the like, the tip part 3 is pressed in the Y-direction. Thereby the breakable part 5 starts to be broken below the second pressing portion 32. With the progress of the breakage, the tip part 3 falls over in the Y-direction.

As shown in FIG. 2, the ribs 32*a*, 32*b*, and 32*c* extend downward from the pressing portion 32, and the protruding lengths increase downward. The rib reinforces the whole of the tip portion 3.

Only one of the pressing portions 31, 32 may be formed. The pressing portions may be formed not of the above-described ribs, but of a flat plate portion.

In the ampule 1 of the present invention, the ampule body 2 has the extension portion 41 extended in the predetermined direction (X-direction) in which the pressing force applied to the pressing portion 31 is guided when the operation of pressing the pressing portion 31 is performed to break the breakable part and the extension portion 42 extended in the predetermined direction (Y-direction) in which the pressing force applied to the pressing portion 32 is guided when the operation of pressing the pressing portion 32 is performed to break the breakable part.

The extension portions 41, 42 are formed at the bottom surface part of the ampule body 2. In the ampule 1 of this embodiment shown in FIGS. 1 through 4, the bottom surface part 4 is formed of the bottom plate member 40. As shown in FIG. 4, the bottom plate member 40 of this embodiment has a plate-shaped bottom plate body and a tubular portion 43 extended upward from an upper surface of the bottom plate body. The tubular portion 43 is in penetration into a lower-end opening 24 of the tubular body 20.

As shown in FIGS. 1 through 4, the bottom plate member 40 forming the bottom surface part 4 has the first extension portion 41 extended outward (radially outward) from a lower-end surface of the tubular body 20. The first extension portion 41 is extended in the first predetermined direction (X-direction) in which the pressing force applied to the pressing portion 31 is guided when the operation of pressing the pressing portion 31 is performed to break the breakable part. Thus, when the ampoule is self-standing and the pressing portion 31 provided at the tip part is pressed in a guiding pressing direction (X-direction), the extension portion 41 provided on the bottom surface 4 (bottom plate member 40) serves as a support, the pressing force applied to the pressing portion 31 can be securely transmitted to the breakable part. Thus, the breakable part can be easily broken.

In the ampule 1 of this embodiment, as shown in FIGS. 1 through 4, the bottom plate member 40 forming the bottom surface part 4 has the second extension portion 42 extended outward (radially outward) from the lower-end surface of the tubular body 20. The second extension portion 42 is so disposed as to oppose the first extension portion 41. The second extension portion 42 is extended in the second predetermined direction (Y-direction) in which the pressing force applied to the pressing portion 32 is guided when the operation of pressing the pressing portion 32 is performed to break the breakable part. Thus, when the ampoule is self-standing and the pressing portion 32 provided at the tip part is pressed in a guiding pressing direction (Y-direction), the extension portion 42 provided on the bottom surface 4 (bottom plate member 40) serves as a support, the pressing force applied to the pressing portion 32 can be securely transmitted to the breakable part. Thus, the breakable part can be easily broken.

In the ampule of this embodiment, as shown in FIGS. 1 through 4, the bottom plate member 40 forming the bottom surface part 4 has two more extension portions 47, 48 extended outward (radially outward) from the lower-end surface of the tubular body 20. In the ampule 1 of this embodiment, the extension portions 47, 48 are so disposed as to be opposed to each other. The extension portions 47, 48 are so disposed that an imaginary line connecting the extension portions 47, 48 to each other is substantially orthogonal to an imaginary line connecting the extension portions 31, 32 to each other. In the ampule of this embodiment, the outer configuration of the bottom surface part 4 (bottom plate member 40) is rectangular, more specifically, almost square. Thus, when the ampule 1 falls over, the ampule is prevented from rotating or swinging.

Figure 5:
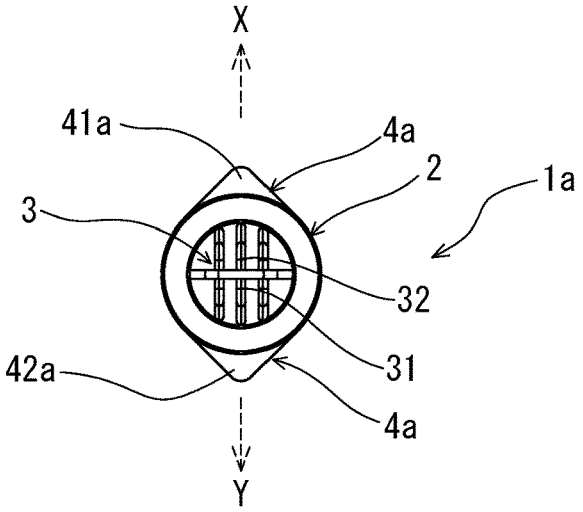
FIG. 5 is a plan view of a drug-filled synthetic resin ampule of another embodiment of the present invention.

The bottom surface part of the drug-filled synthetic resin ampule, of the present invention may have the form of an ampule 1*a* of an embodiment shown in FIG. 5. In the ampule 1*a* of this embodiment, a bottom surface part 4*a* has only two opposed extension portions 41*a*, 42*a*. As with the above-described ampule 1, the extension portion 41*a* is extended in the X-direction, whereas the extension portion 42*a* is extended in the Y-direction. An outer edge of each of the extension portions 41*a*, 41*b* is rounded. The bottom surface part 4*a* of the ampule 1*a* of this embodiment does not have any extension portion other than the extension portions 41*a*, 41*b*. Thus, in the ampule 1*a* of this embodiment, the distance from the center of the bottom surface part 4*a* to an outer edge of each of the extension portions 41*a*, 42*a* is longest of all distances from the center of the bottom surface part 4*a* to outer edges thereof. As with the ampules of the above-described embodiments, because the ampule 1*a* is provided with the extension portion, the ampule can be prevented from rolling when the ampule falls over.

Figure 6:
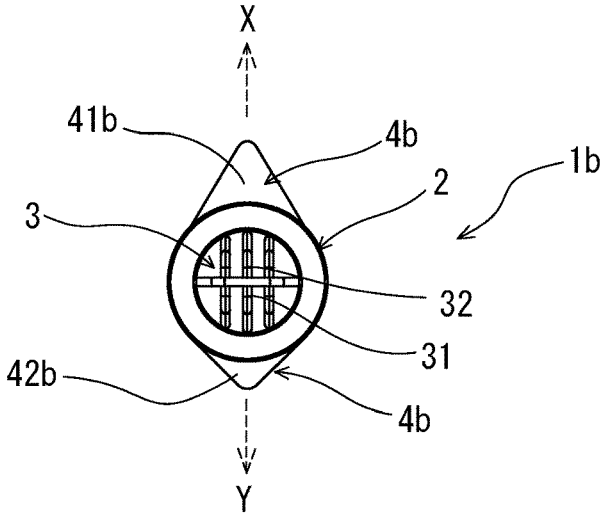
FIG. 6 is a plan view of a drug-filled synthetic resin ampule of another embodiment of the present invention.

The bottom surface part of the drug-filled synthetic resin ampule of the present invention may have a form of an ampule 1*b* of an embodiment shown in FIG. 6. In the ampule 1*b* of this embodiment, a bottom surface part 4*b* has only two opposed extension portions 41*b*, 42*b*. As with the above-described ampule 1, the extension portion 41*b* is extended in the X-direction, whereas the extension portion 42*b* is extended in the Y-direction. An outer edge of each of the extension portions 41*b*, 42*b* is rounded. The bottom surface part 4*b* of this embodiment does not have any extension portion other than the extension portions 41*b*, 42*b*. The extension portion 41*b* is formed longer than the extension portion 42*b* in its extension length. Thus, in the ampule 1*b* of this embodiment, the distance from the center of the bottom surface part 4*b* to an outer edge of the extension portion 41*b* is longest of all distances from the center of the bottom surface part 4*b* to outer edges thereof. As with the ampules of the above-described embodiments, because the ampule 1*b* is provided with the extension portion, the ampule can be prevented from rolling when the ampule falls over.

Figure 7:
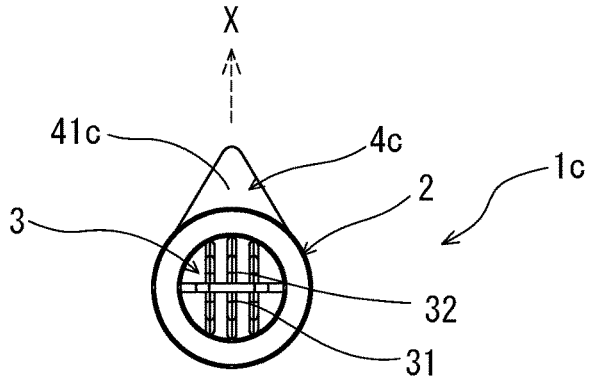
FIG. 7 is a plan view of a drug-filled synthetic resin ampule of another embodiment of the present invention.
Figure 8:
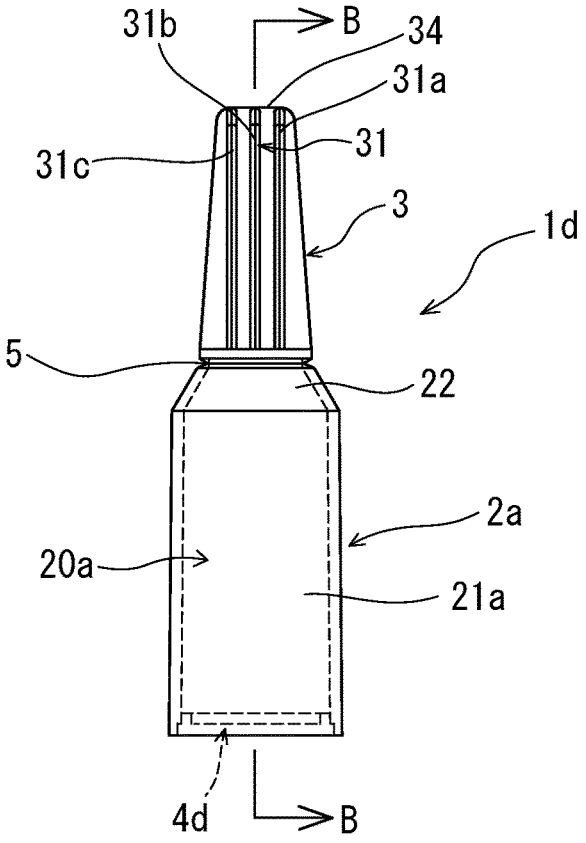
FIG. 8 is a front view of a drug-filled synthetic resin ampule of another embodiment of the present invention.
Figure 9:
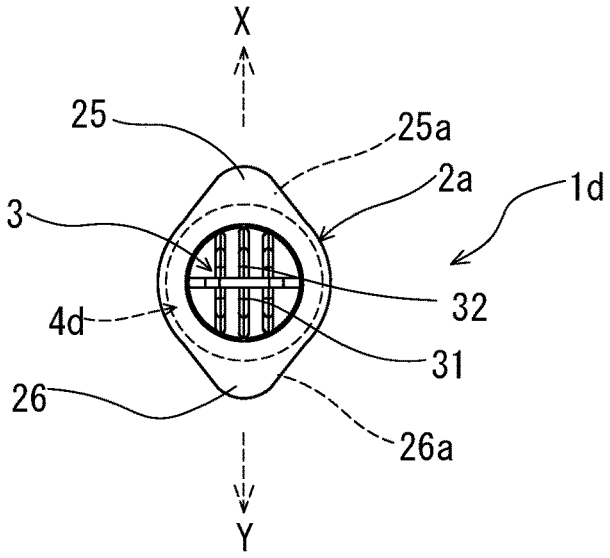
FIG. 9 is a plan view of the drug-filled synthetic resin ampule of FIG. 8.
Figure 10:
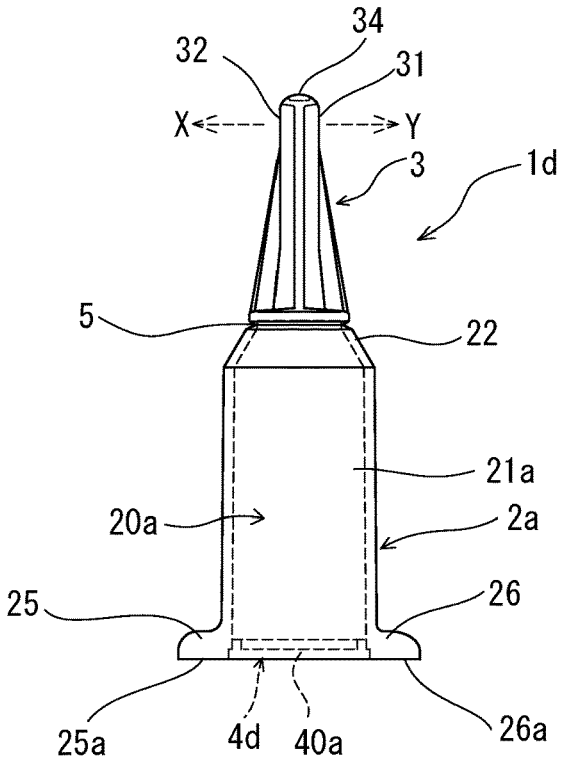
FIG. 10 is a left-side view of the drug-filled synthetic resin ampule of FIG. 9.

The bottom surface part of the drug-filled synthetic resin ampule of the present invention may have a form of an ampule 1*c* of an embodiment shown in FIG. 7. In the ampule 1*c* of this embodiment, a bottom surface part 4*c* has only one extension portion 41*c*. As with the above-described ampule 1, the extension portion 41*c* is extended in the X-direction. An outer edge of the extension portion 41*c* is rounded. The bottom surface part 4*c* of this embodiment does not have any extension portion other than the extension portion 41*c*. Thus, in the ampule 1*c* of this embodiment, the distance from the center of the bottom surface part 4*c* to an outer edge of the extension portion 41*c* is longest of all distances from the center of the bottom surface part 4*c* to outer edges thereof. As with the ampules of the above-described embodiments, because the ampule 1*c* is provided with the extension portion, the ampule can be prevented from rolling when the ampule falls over.

A drug-filled synthetic resin ampule 1*d* of an embodiment shown in FIGS. 8 through 11 is described below.

The difference between the drug-filled synthetic resin ampule 1*d* of this embodiment and the ampule 1 of the above-described embodiment lies in the difference between the formation forms of both bottom surface parts, more specifically, in the difference between the forms of the lower parts of tubular bodies of both ampules and between the forms of bottom plate members of both ampules. The forms of other parts of both ampules are the same. Refer parts of the ampule 1*d* denoted by the same reference numerals as those used for the ampule 1 to the above-described description.

In the ampule 1*d* of this embodiment, a tubular body 20*a* of an ampule body 2*a* has a hollow part 21*a* extended upward, the tip part 3 positioned upward from the hollow part, and the breakable part 5 provided between the lower portion of the tip part 3 and the upper portion of the hollow part 21*a*, in other words, so provided as to form a boundary portion between the tip part 3 and the hollow part 21*a*. The tubular body 20*a* of the ampule body 2*a* has bulge portions 25, 26 extended outward from a lower-end opening of the tubular body 20*a*. A bottom surface part 4*d* has extension portions 25*a* and 26*a* formed by a lower surface of the bulge portion 25 and that of the bulge portion 26 respectively.

The tubular body 20*a* has a first bulge portion 25 bulged outward (radially outward) from its lower end. The lower surface of the bulge portion 25 is formed as a flat surface which forms a first extension portion 25*a*. The first extension portion 25*a* is extended in the first predetermined direction (X-direction) in which the pressing force applied to the pressing portion 31 is guided when the operation of pressing the pressing portion is performed to break the breakable part. Thus, when the ampoule is self-standing and the pressing portion 31 provided at the tip part is pressed in a guiding pressing direction (X-direction), the extension portion 25*a* provided at the tubular body 20*a* (bottom plate member 40*a*) serves as a support, the pressing force applied to the pressing portion 31 can be securely transmitted to the breakable part. Thus, the breakable part can be easily broken.

Similarly, the tubular body 20*a* has a second bulge portion 26 bulged outward (radially outward) from its lower end. The lower surface of the bulge portion 26 is formed as a flat surface which forms a second extension portion 26*a*. The second extension portion 26*a* is extended in the second predetermined direction (Y-direction) in which the pressing force applied to the pressing portion 32 is guided when the operation of pressing the pressing portion is performed to break the breakable part. Thus, when the ampoule is self-standing and the pressing portion 32 provided at the tip part is pressed in a guiding pressing direction (Y-direction), the extension portion 26*a* provided at the tubular body 20*a* serves as a support, the pressing force applied to the pressing portion 32 can be securely transmitted to the breakable part. Thus, the breakable part can be easily broken.

Figure 11:
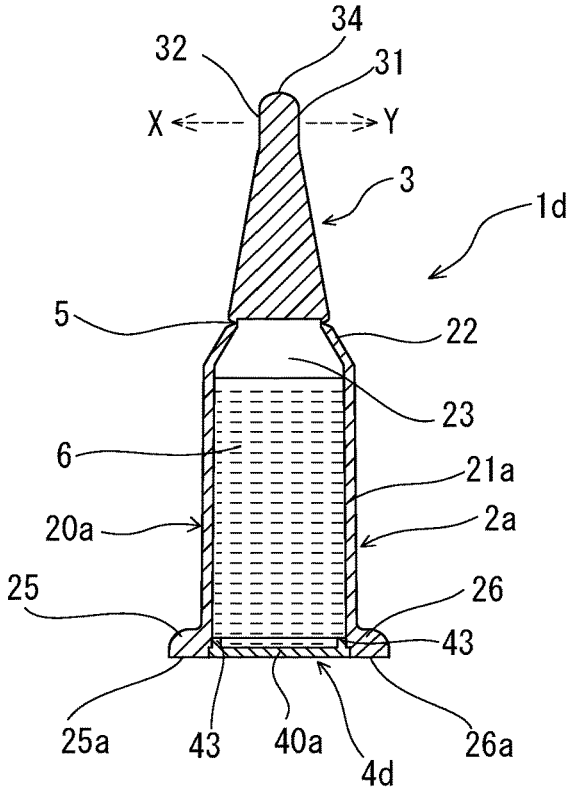
FIG. 11 is a sectional view taken along a line B-B of FIG. 10.

In the ampule 1*d* of this embodiment, as shown in FIG. 11, the bottom plate member 40*a* sealing the lower-end opening of the tubular body 20*a* has a form fittable into a concave portion formed on a lower-end surface of the tubular body 20*a*. An outer edge of the bottom plate member 40*a* does not reach an outer edge of the tubular body 20*a*.

In the ampule 1*d* of this embodiment, the bottom surface part 4*d* has only the two extension portions 25*a*, 26*a* (bulge portions 25, 26) opposed to each other. The bottom surface part 4*d* of this embodiment does not have an extension portion other than the extension portions 25*a*, 26*a*. Thus, in the ampule 1*d* of this embodiment, the distance from the center of the bottom surface part 4*d* to an outer edge of each of the extension portions 25*a*, 26*a* is longest of all distances from the center of the bottom surface part 4*d* to outer edges thereof. As with the above-described ampule 1, the bottom surface part of the ampule 1*d* may be provided with four extension portions. As with the ampule 1*c* of the above-described embodiment, the bottom surface part of the ampule 1*d* may be provided with only one extension portion. More specifically, as with the above-described ampule 1*c*, the bottom surface part of the ampule 1*d* may be provided with only the bulge portion 25 (extension portion 25*a*) or only the bulge portion 26 (extension portion 26*a*).

Figure 12:
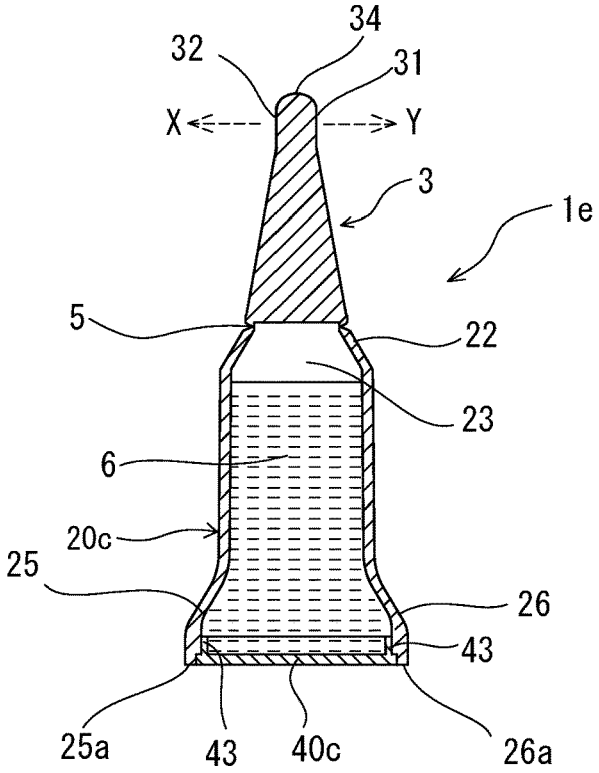
FIG. 12 is a vertical sectional view of a drug-filled synthetic resin ampule of another embodiment of the present invention.

Like the above-described ampule 1*d* in which the tubular body has the bulge portion and the extension portion is formed of the lower-end surface of the bulge portion, the bulge portion of the tubular body may be formed as a hollow part like a drug-filled synthetic resin ampule 1*e* of an embodiment shown in FIG. 12. In the ampule 1*e* of this embodiment, a tubular body 20*c* is hollow at its lower-end portion and has the bulge portions 25, 26 bulged outward. The extension portions 25*a*, 26*a* are formed of lower-end surfaces of these bulge portions and an outer edge of a bottom plate member 40*c*.

Figure 13:
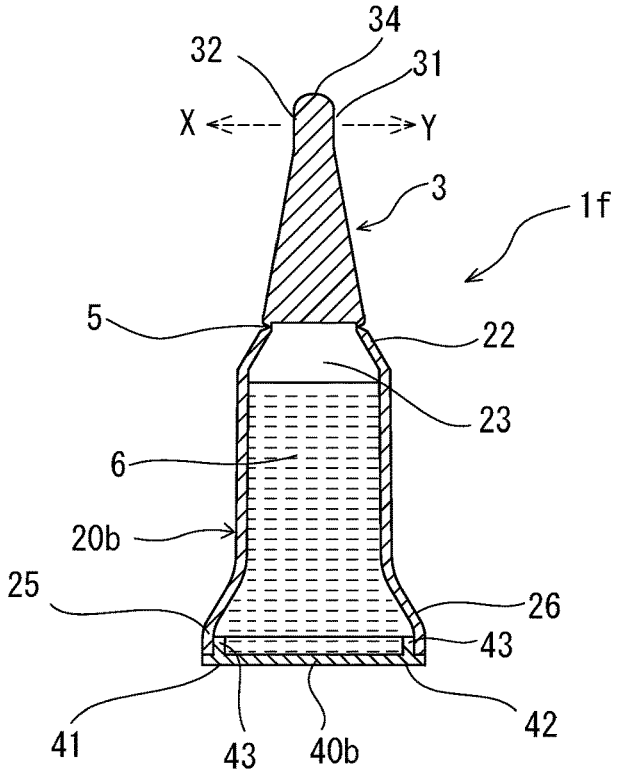
FIG. 13 is a vertical sectional view of a drug-filled synthetic resin ampule of another embodiment of the present invention.

Like a drug-filled synthetic resin ampule 1*f* of an embodiment shown in FIG. 13 in which the extension portion is formed of the bottom plate member, the tubular body may have a lower bulge portion. The bulge portion may be formed as a hollow portion like a synthetic resin ampule 1*f* of an embodiment shown in FIG. 13. In the ampule 1*f* of this embodiment, a tubular body 20*b* is hollow at its lower end portion and has the bulge portions 25, 26 bulged outward. Extension portions 41, 42 is formed by an outer edge of a bottom plate member 40*b* mounted on the tubular body.

Figure 14:
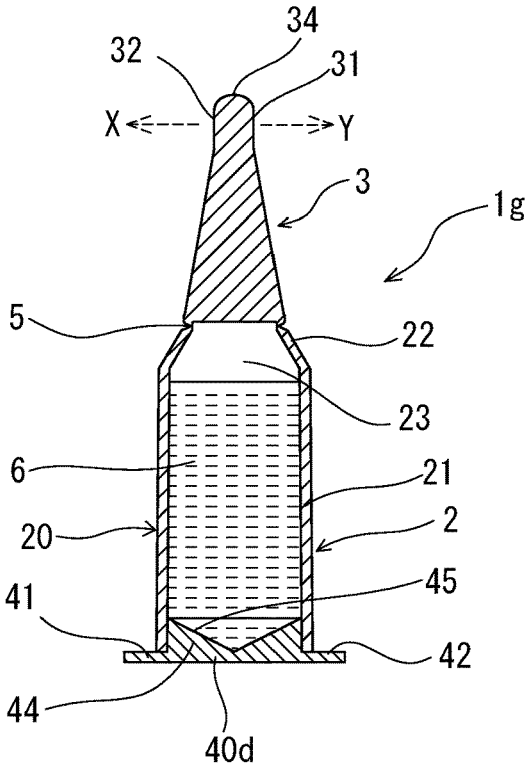
FIG. 14 is a vertical sectional view of a drug-filled synthetic resin ampule of another embodiment of the present invention.
Figure 15:
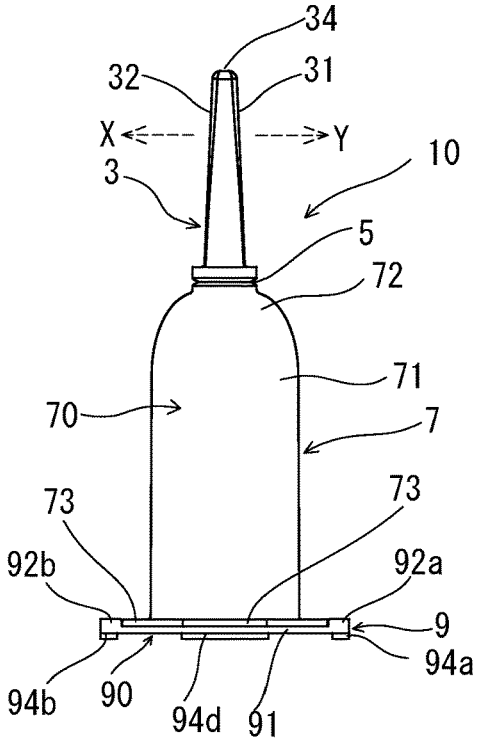
FIG. 15 is a front view of a drug-filled synthetic resin ampule of another embodiment of the present invention.
Figure 16:
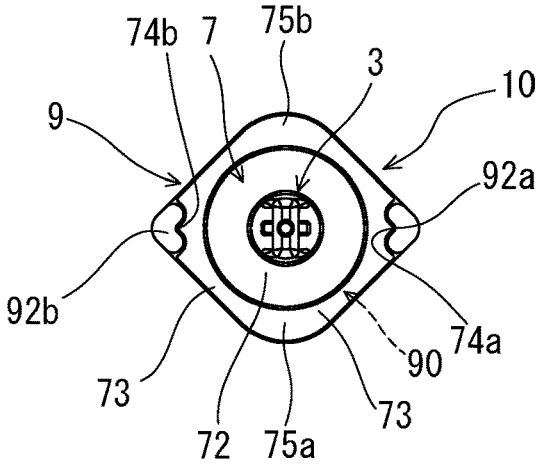
FIG. 16 is a plan view of the drug-filled synthetic resin ampule of FIG. 15.
Figure 17:
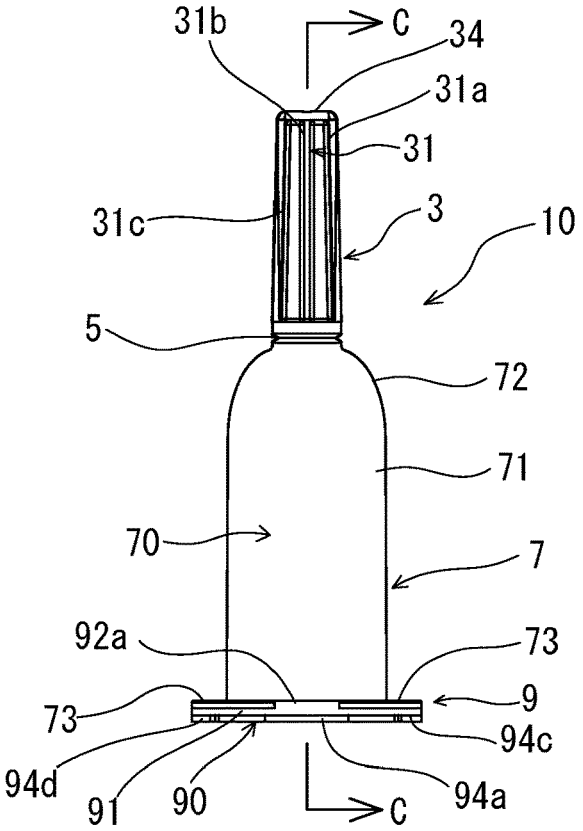
FIG. 17 is a right-side view of the drug-filled synthetic resin ampule of FIG. 15.
Figure 18:
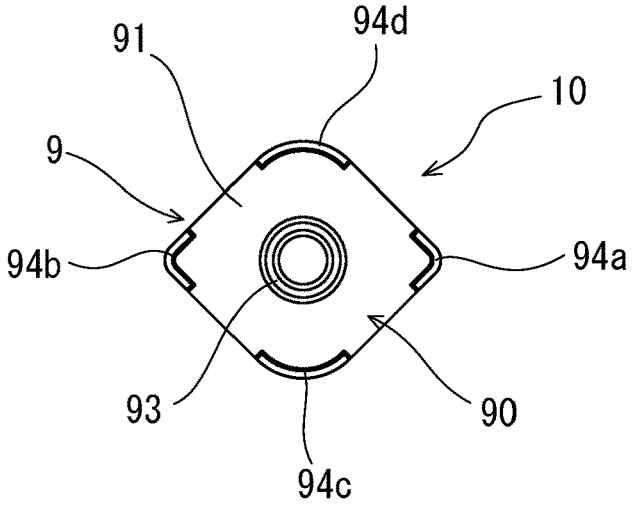
FIG. 18 is a bottom view of the drug-filled synthetic resin ampule of FIG. 15.
Figure 19:
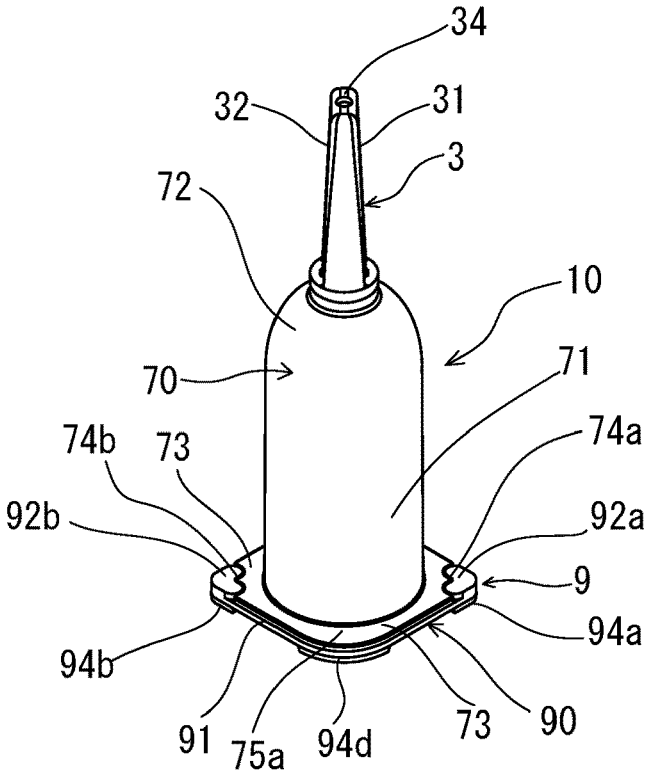
FIG. 19 is a perspective view of the drug-filled synthetic resin ampule of FIG. 15.

As with a bottom plate member 40*d* of an ampule 1*g* shown in FIG. 14, bottom plate members of all the embodiments may have a conical upper surface 45 tilting toward the center of a bottom surface portion of a drug accommodation portion. In this embodiment, an upper surface of an insertion portion 44 inserted into the tubular body is formed as a conical upper surface 45 whose diameter decreases toward the center of the bottom plate member 40*d*. The conical upper surface may be formed as a polygonal pyramidal upper surface. By providing the bottom plate member with the conical upper surface, a drug gathers to the center of the conical upper surface 45 when a drug collection operation finishes. Thus, it is possible to collect the drug more securely.

The drug-filled synthetic resin ampule of the present invention is sterilized by subjecting the ampule to pressurized steam with a drug being filled and sealed therein. It is especially preferable to sterilize the ampule by subjecting it to the pressurized steam at a temperature of not less than 120 degrees C. More specifically, as a condition of the pressurized steam sterilization, an overkill condition (ISO/TS 17665-2) having a temperature of 121 degrees C. and a period of time of fifteen minutes is preferable.

As materials for composing the drug-filled synthetic resin ampule body (tubular body and bottom plate member), those which can be sterilized with pressurized steam are preferable. Materials applicable to the above-described overkill condition are especially preferable. Specifically, examples of materials for composing the ampule body includes various resins such as hard polyvinyl chloride, polyethylene, polypropylene, polybutadiene, and cyclic polyolefin. More specifically, it is possible to exemplify polyolefin such as ZEONEX (Nippon Zeon Co., Ltd.), APEL (Mitsui Chemicals, Inc), polypropylene homopolymer, high-density polyethylene; polystyrene, poly-(4-methylpentene-1), polycarbonate, ABS resin, acrylic resin, polymethylmethacrylate (PMMA), polyacetal, polyarylate, polyacrylonitrile, polyvinylidene fluoride, ionomer, acrylonitrile-butadiene-styrene copolymer, polyester such as polyethylene terephthalate (PET), polybutylene terephthalate (PBT), butadiene-styrene copolymer, aromatic or aliphatic polyamide, and combinations of these resins.

As described above, the synthetic resin ampule body of the present invention is molded by means of injection molding. Thus, it is preferable to use various hard resins suitable for the injection molding.

A drug-filled synthetic resin ampule of an embodiment, shown in FIGS. 15 through 24 is described below.

A drug-filled synthetic resin ampule 10 of this embodiment has an ampule body 7 capable of standing by itself and the drug 6 accommodated inside the ampule body 7. The ampule body 7 has the tip part 3 positioned at an upper portion thereof when the ampule body stands by itself, a hollow part 71 having a drug accommodation portion 78, and the breakable part 5 provided between the lower portion of the tip part 3 and an upper portion of the hollow part 71. The tip part 3 has the pressing portions 31, 32 for guiding the pressing force applied thereto respectively in the predetermined direction when the operation of breaking the breakable part 5 is performed. The hollow part 71 has a bottom surface part 9 for allowing the ampule body to stand by itself. The bottom surface part 9 has extension portions 92*a*, 92*b* extended in the predetermined directions (X-direction, Y-direction) in which the pressing force applied to the pressing portions 31, 32 respectively is guided when the operation of pressing the pressing portions 31, 32 is performed to break the breakable part.

As shown in FIGS. 15 through 23, the drug-filled synthetic resin ampule 10 of this embodiment has the ampule body 7 capable of standing by itself and the drug 6 accommodated inside the ampule body 7. The ampule body 7 has a tubular body 70 and a bottom plate member 90 sealing a lower-end opening of the tubular body 70. The basic construction of the drug-filled synthetic resin ampule 10 of this embodiment is the same as that of the above-described drug-filled synthetic resin ampule 1. The main difference between the ampules 10 and 1 lies in the difference between the construction of the bottom surface part 9 of the ampule 10 and that of the bottom surface part of the ampule 1 and the form of the upper portion of the hollow part 71 of the tubular body 70 of the ampule 10 and that of the upper portion of the hollow part of the tubular body of the ampule 1.

As shown in FIGS. 15 through 23, the ampule body 7 has the tip part 3 positioned at the upper part thereof when the ampule body stands by itself, the hollow part 71 having the drug accommodation portion 78, and the breakable part 5 provided between the lower portion of the tip part 3 and the upper portion of the hollow part 71. In the ampule 10 of this embodiment, the ampule body 7 capable of standing by itself has the tubular body 70 and the bottom plate member 90 sealing the lower-end opening of the tubular body 70. The tubular body 70 has the hollow part 71, the tip part 3, and the breakable part 5.

Figure 20:
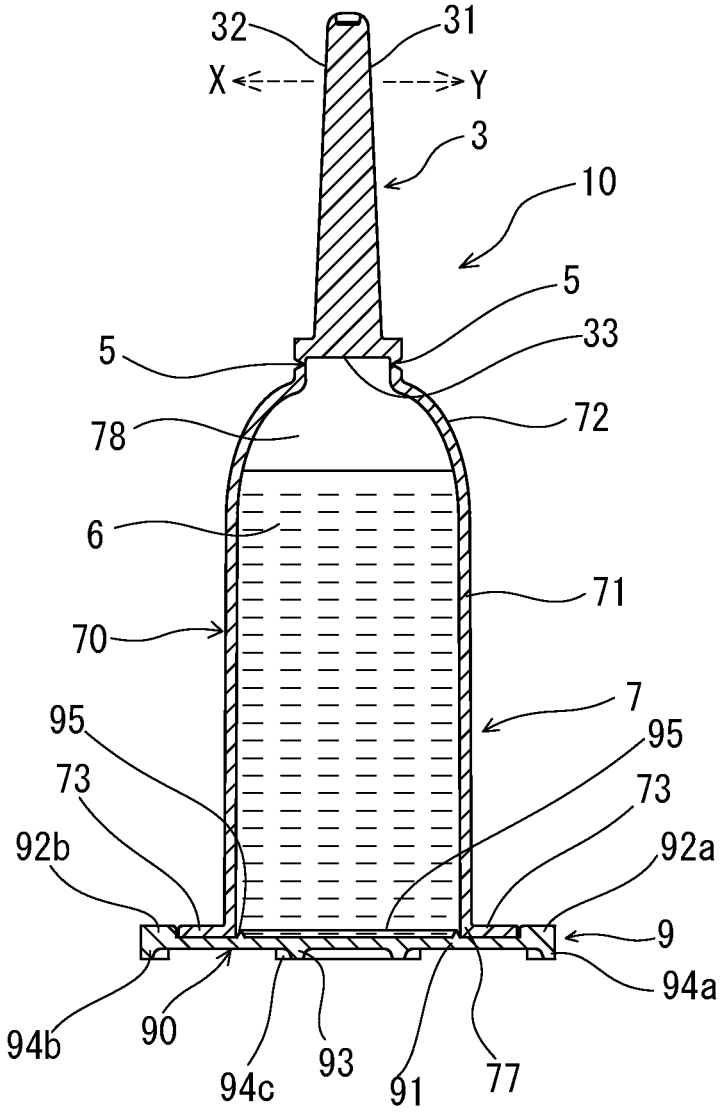
FIG. 20 is an enlarged sectional view taken along a line C-C of FIG. 17.
Figure 21:
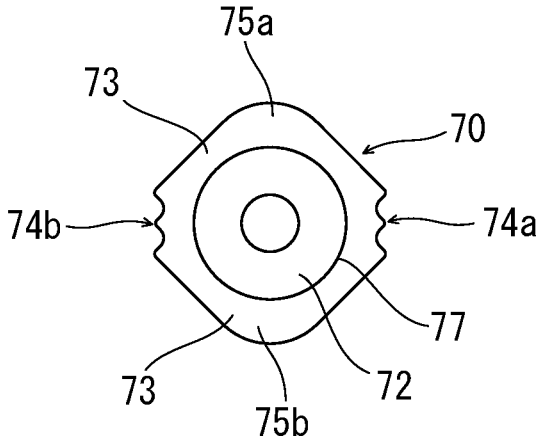
FIG. 21 is a bottom view of a tubular body for use in the drug-filled synthetic resin ampule of FIG. 15.

The tubular body 70 has the lower-end opening and includes the hollow part 71 extended upward, the tip part 3 positioned upward from the hollow part, and the breakable part 5 provided between the lower portion of the tip part 3 and the upper portion of the hollow part 71, in other words, so provided as to form a boundary portion between the tip part 3 and the hollow part 71. The hollow part 71 has the drug accommodation portion 78. It is preferable that the volume of the drug accommodation portion 78 is 0.5 to 50 ml. As shown in FIG. 20, the hollow part 71 has a cylindrical portion extended a predetermined length in substantially the same outer and inner diameters and a diameter-decreased portion 72 positioned upward from the cylindrical portion. Thus, in the ampule 10 of this embodiment, both the inner and outer diameters of the hollow part 71 decrease toward the breakable part 5.

Figure 24:
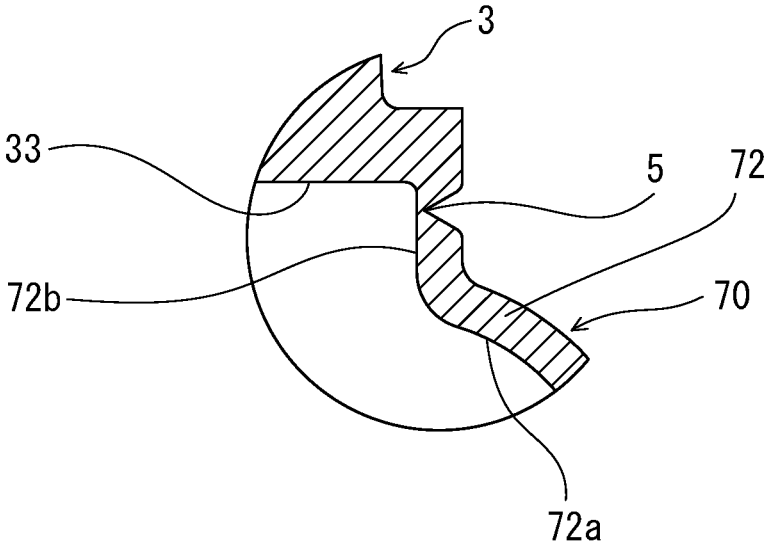
FIG. 24 is an enlarged view of a neighborhood of a breakable part of the drug-filled synthetic resin ampule of FIG. 20.

As shown in FIGS. 20 and 24, the diameter-decreased portion 72 has a curved inner surface portion 72*a* whose diameter decreases curvedly from a front end of the cylindrical portion and a cylindrical inner surface portion 72*b* extended in an almost equal diameter from a front end of the curved inner surface portion 72*a* to an inner bottom surface part 33 of the tip part 3. The breakable part 5 is positioned at the cylindrical inner surface portion 72*b*, more specifically, at an upper portion (portion proximate to inner bottom surface part 33 of tip part 3) of the cylindrical inner surface portion 72*b*. The above-described form allows the blade surface of a needle tip to smoothly contact the curved inner surface portion 72*a* in sucking a liquid medicine into a syringe.

The tubular body 70 can be molded by means of injection molding. The bottom plate member 90 is mounted on the tubular body 70 by means of ultrasonic welding or high frequency welding.

The inner diameter of the cylindrical portion of the tubular body 70 is preferably 6 to 33 mm and especially preferably 7 to 24 mm. The outer diameter of the cylindrical portion is preferably 7 to 35 mm and especially preferably 10 to 25 mm. The inner diameter of the cylindrical inner surface portion 72*b* of the diameter-decreased portion 72 is preferably 3 to 12 mm and especially preferably 3 to 9 mm.

It is preferable to transparently form the hollow part (drug accommodation portion 78) of the tubular body 70 to allow the drug accommodated therein to be visible. Although the pressure inside the drug accommodation portion 78 of the tubular body 70 may be set normally, the pressure therein may be set to a decreased pressure state or a vacuum state in a case where resin used has gas barrier properties. In a case where the pressure inside the drug accommodation portion is set to the decreased pressure state or the vacuum state, it is possible to increase the effect of preventing the drug from deteriorating and decomposing due to a change in its quality. As the drug 6 to be accommodated inside the drug accommodation portion 78, those described above are used.

The breakable part 5 is a thin and fragile part provided in the vicinity of the boundary portion between the drug accommodation portion 78 and the tip part 3. In this embodiment, the thin and fragile part (breakable part) is formed of an annular groove formed on an outer surface of the tubular body 70. More specifically, the thin and fragile part is formed on the outer surface of an upper-end portion of the diameter-decreased portion 72 of the tubular body 70. By bending the tip part 3 with respect to the tubular body 70, the breakable part 5 is broken. As a result, the drug accommodation portion 78 is opened. A groove-formed portion is V-shaped in its sectional configuration.

Including all the above-described embodiments, the angle of the groove-formed portion in its section is preferably 30 to 90 degrees and especially preferably 50 to 70 degrees. The groove-formed portion having an angle in the above-described range allows a stress to concentrate on the center of the breakable part when the tip part 3 is bent. Thereby the breakable part is securely broken. The thickness of the tubular body 70 at the breakable part 5 thereof is preferably 0.05 to 0.5 mm and especially preferably 0.1 to 0.4 mm.

The breakable part and the groove-formed portion may be formed in any configuration so long as the configurations thereof are easily breakable. In addition to the V-shaped configuration of the breakable part and the groove-formed portion adopted in the embodiments, the configurations thereof may be semicircular, semi-elliptic or the like. The groove-formed portion may be so formed that its thickness is relatively smaller than that of the neighborhood thereof to easily break the groove-formed portion. In addition, the breakable part may be formed of a material more fragile than that of other portions of the tubular body. More specifically, it is preferable to use multicolor molding to annularly form only the neighborhood of the breakable part of a material which can be easily broken. Other portions of the tubular body are made of a material which cannot be easily broken. Although in the embodiments of the present invention, the groove-formed portion is formed annularly and continuously on the entire outer circumference of the drug accommodation portion, the groove-formed portion may be intermittently formed on the entire outer circumference thereof.

It is possible to chamfer the edge of the annular groove-formed portion which forms the breakable part 5 at the side of the above-described tapered portion and the edge of the annular groove-formed portion at the side of the tip part. More specifically, it is possible to round the outer edge of the annular groove-formed portion at the side of the tapered portion and the outer edge of the annular groove-formed portion at the side of the tip part.

The tip part 3 forms the upper part of the ampule body 7 and is positioned at an upper part of the tubular body 70. The tip part 3 has the pressing portions 31, 32 for guiding the pressing force applied thereto in the predetermined direction when the operation of breaking the breakable part 5 is performed. The tip part 3 is the same as that described on the above-described synthetic resin ampule 1.

The ampule 10 of this embodiment has the bottom surface part 9 for allowing the ampule to stand by itself. Because the synthetic resin ampule 10 has the bottom surface part 9, the ampule is allowed to stand by itself with the upper portion of the hollow part facing upward and with the front end of the tip part 3 also facing upward. It is preferable that the synthetic resin ampule 10 stands by itself without staggering. In a case where the ampule swings or tilts, it is preferable that the ampule does so to allow the operation of breaking the breakable part 5 to be performed and in addition in the first predetermined direction (X-direction) or the direction (Y-direction) opposite to the first predetermined direction.

By pressing the first pressing portion 31 with fingers or the like, the tip part 3 is pressed in the X-direction. Thereby the breakable part 5 starts to be broken below the first pressing portion 31. With the progress of the breakage, the tip part 3 falls over in the X-direction. Similarly, by pressing the second pressing portion 32 with fingers or the like, the tip part 3 is pressed in the Y-direction. Thereby the breakable part 5 starts to be broken below the second pressing portion 32. With the progress of the breakage, the tip part 3 falls over in the Y-direction.

In the ampule 10 of this embodiment, the bottom surface part 9 has the extension portion 92*a* extended in the predetermined direction (Y-direction) in which the pressing force applied to the pressing portion 32 is guided when the operation of pressing the pressing portion 32 of the tip part 3 is performed to break the breakable part and the extension portion 92*b* extended in the predetermined direction (X-direction) in which the pressing force applied to the pressing portion 31 is guided when the operation of pressing the pressing portion 31 of the tip part 3 is performed to break the breakable part.

In the ampule 10 of this embodiment, the bottom surface part 9 is formed of the bottom plate member 90 and a flange portion 73 provided at a lower end 77 of the tubular body 70. More specifically, in the ampule 10 of this embodiment, the ampule body 7 has the flange portion 73, provided at the lower end 77 of the hollow part, which is extended outward and the bottom plate member 90 which seals an opening formed at the lower end 77 of the hollow part and whose upper surface is in contact with a lower surface of the flange portion 73. Because the bottom surface part 9 is formed of the flange portion and the bottom plate member 90 on which the flange portion is layered, the bottom surface part 9 has a sufficiently high degree of strength and rigidity.

As shown in FIGS. 15 through 21, the flange portion 73 of the tubular body 70 is extended outward from the lower end 77 of the outer tube body 70 and is disk-shaped. The flange portion 73 has a substantially uniform thickness. In the ampule of this embodiment, the flange portion 73 has two concave portions 74*a*, 74*b* opposed to each other. The concave portions 74*a*, 74*b* are formed wavily. The flange portion 73 has two curved corners 75*a*, 75*b* opposed to each other. An outer edge of the flange portion 73 connecting the concave portions 74*a* and 74*b* to each other and an outer edge thereof connecting the curved corners 75*a* and 75*b* to each other are extended substantially linearly. Thus, the flange portion 73 is rectangular plate-shaped, and one pair of corners opposed to each other has the concave portions, whereas another pair of corners opposed to each other has the curved corners.

Figure 22:
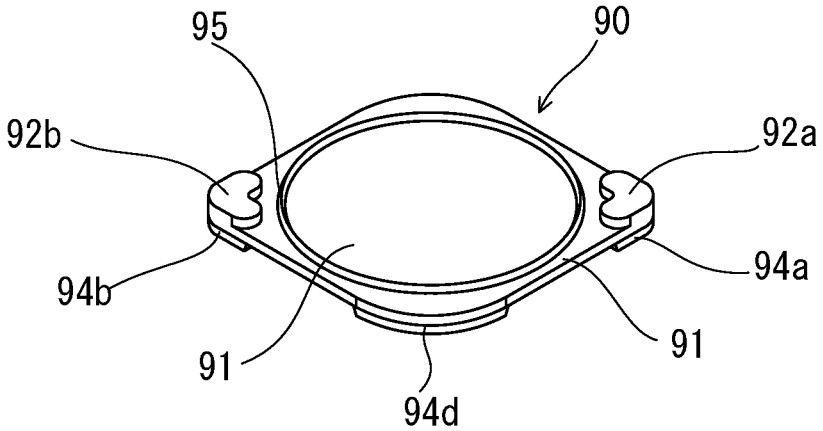
FIG. 22 is an upper-side perspective view of a bottom plate member for use in the drug-filled synthetic resin ampule of FIG. 15.

As shown in FIG. 22, the bottom plate member 90 has a base plate part 91 and extension portions 92*a*, 92*b* positioned at opposed corners of the base plate part 91. The extension portion 92*a* is extended in the predetermined direction (Y-direction) in which the pressing force applied to the pressing portion 32 of the tip part 3 is guided when the operation of pressing the pressing portion 32 is performed to break the breakable part. The extension portion 92*b* is extended in the predetermined direction (X-direction) in which the pressing force applied to the pressing portion 31 of the tip part 3 is guided when the operation of pressing the pressing portion 31 is performed to break the breakable part.

Each of the extension portions 92*a*, 92*b* is formed as a projected portion projected upward. More specifically, the extension portions 92*a*, 92*b* form approximately heart-shaped projections whose central concave portions are opposed to each other. Each of the extension portions 92*a*, 92*b* has a bulge portion formed at both sides of the central concave portion. The extension portion 92*a* is in engagement with the concave portion 74*a* of the flange portion 73, whereas the extension portion 92*b* is in engagement with the concave portion 74*b* of the flange portion 73. As shown in FIG. 22, the bottom plate member 90 of this embodiment has an annular rib 95 formed on an upper surface of the base plate part 91. As shown in FIG. 20, the annular rib 95 enters an open portion of the lower end 77 of tubular body 70 and engages the tubular body 70. In fusion-bonding the bottom plate member 90 to the flange portion 73 (open portion of lower end 77) of the tubular body 70 by ultrasonic waves, the annular rib 95 can be utilized as an ultrasonic sealing rib.

Figure 23:
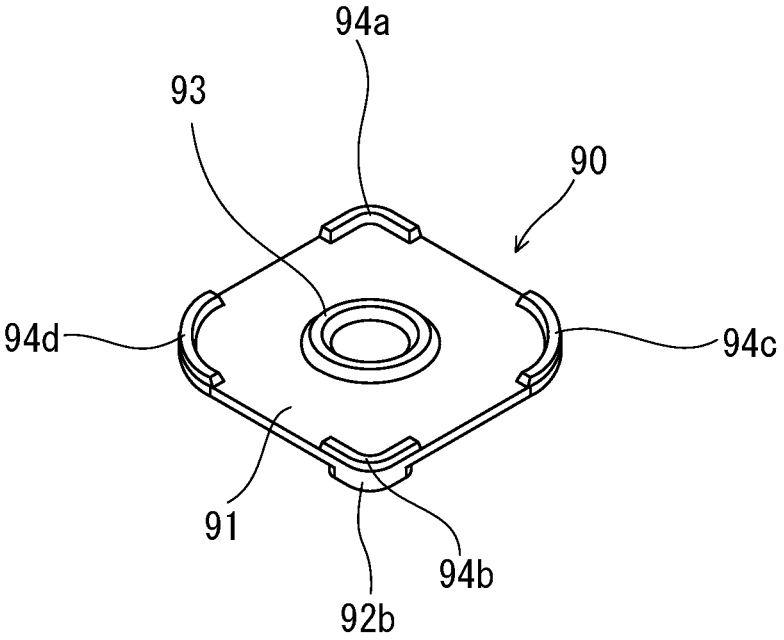
FIG. 23 is a bottom-side perspective view of the bottom plate member for use in the drug-filled synthetic resin ampule of FIG. 15.

As shown in FIG. 23, the bottom plate member 90 of this embodiment has a central annular lower rib 93 formed on a lower surface of the base plate part 91 and corner lower ribs 94*a*, 94*b*, 94*c*, and 94*d* formed at corners of the base plate part. Lower surfaces of the central annular lower rib 93 and those of the corner lower ribs 94*a*, 94*b*, 94*c*, and 94*d* are located on almost the same plane. The annular rib 95 is located above the central annular lower rib 93. The extension portion 92*a* is located above the corner lower rib 94*a*. The extension portion 92*b* is located above the corner lower rib 94*b*. The bottom plate portion 9 is formed by layering the flange portion 73 of the tubular body 70 on the upper surface of the bottom plate member 90. As with the above-described embodiments, in the ampule 10 of this embodiment, the outer configuration of the bottom surface part 9 (bottom plate member 90) is rectangular, more specifically, almost square. Thus, when the ampule 10 falls over, the ampule is prevented from rotating or swinging. Because all the corners are rounded, an operator is not given pain when the operator grips the ampule.

INDUSTRIAL APPLICABILITY

The self-standing drug-filled synthetic resin ampule of the present invention has the following form:

(1) A self-standing drug-filled synthetic resin ampule comprising an ampule body capable of standing by itself and a drug accommodated inside said ampule body, wherein said ampule body has a tip part positioned at an upper part thereof when the ampule body stands by itself, a hollow part having a drug accommodation portion, and a breakable part provided between a lower portion of said tip part and an upper portion of said hollow part; and said tip part has a pressing portion for guiding a pressing force applied thereto in a predetermined direction when an operation of breaking said breakable part is performed; said hollow part has a bottom surface part for allowing said ampule body to stand by itself; and said bottom surface part has an extension portion extended in said predetermined direction thereto a pressing force applied guided by said pressing portion.

The drug-filled synthetic resin ampule of the present invention has the bottom surface part for allowing the ampule body to stand by itself. The bottom surface part has the extension portion extended in the predetermined direction of the pressing portion. Thus, when the ampoule is self-standing and the pressing portion provided at the tip part is pressed in a guiding pressing direction (X-direction), the extension portion provided on the bottom surface serves as a support, the pressing force applied to the pressing portion can be securely transmitted to the breakable part. Thus, the breakable part can be broken easily and safely. Thus, it is possible to perform an operation of opening the ampule very easily with the ampule standing by itself. Further, it is possible to prevent an operator from being exposed to a drug due to scattering thereof. In addition, because the container is rarely broken or fall over, it rarely occurs that the drug outflows from a container. Thus, it is possible to safely manage and use the drug needed to be strictly managed. Furthermore, because the synthetic resin ampule keeps standing by itself after it is opened, it is easy to perform an operation of sucking the drug.

The above-described embodiments may be carried out as follows:

(2) A self-standing drug-filled synthetic resin ampule according to the above (1), wherein said tip part has a first pressing portion for performing said operation of breaking said breakable part and guiding said pressing force applied thereto in a first predetermined direction, and a second pressing portion for performing said operation of breaking said breakable part and guiding said pressing force applied thereto in a direction opposite to said first predetermined direction; and said bottom surface part has a first extension portion extended in said first predetermined direction and a second extension portion extended in said direction opposite to said first predetermined direction.

(3) A self-standing drug-filled synthetic resin ampule according to the above (1) or (2), wherein said ampule body does not have a drug-storable portion in an upper portion than said breakable part including said tip part.

(4) A self-standing drug-filled synthetic resin ampule according to any one of the above (1) through (3), wherein a distance from a center of said bottom surface part to an outer edge of said extension portion is longest of all distances from said center of said bottom surface part to outer edges thereof.

(5) A self-standing drug-filled synthetic resin ampule according to any one of the above (1) through (4), wherein said ampule body has a bottom plate member sealing a lower-end opening of said hollow part.

(6) A self-standing drug-filled synthetic resin ampule according to the above (5), wherein said bottom plate member has a conical upper surface tilting toward a center of a bottom surface portion of said drug accommodation portion.

(7) A self-standing drug-filled synthetic resin ampule according to the above (5) or (6), wherein said extension portion is provided at said bottom plate member.

(8) A self-standing drug-filled synthetic resin ampule according to any one of the above (1) through (6), wherein said extension portion is provided at a lower-end portion of said hollow part.

(9) A self-standing drug-filled synthetic resin ampule according to any one of the above (1) through (8), wherein said hollow part has an inner-surface tapered portion whose diameter decreases toward said breakable part.

(10) A self-standing drug-filled synthetic resin ampule according to any one of the above (1) through (4), wherein said ampule body has a flange portion, provided at a lower-end opening of said hollow part, which is extended outward and a bottom plate member, sealing said lower-end opening of said hollow part, whose upper surface is in contact with a lower surface of said flange portion.

The invention claimed is:

1. A self-standing drug-filled synthetic resin ampule comprising:

an ampule body capable of standing by itself, wherein said ampule body comprises:

a tip part positioned at an upper part of the ampule body when the ampule body stands by itself, wherein the tip part comprises:

a plate-shaped body portion, and a first pressing portion located at least at an upper portion of said plate-shaped body portion, a tubular part comprising a drug accommodation portion that accommodates a drug, a bottom surface part that is immovably connected to the tubular part and that allows said ampule body to stand by itself, wherein said bottom surface part comprises a first extension portion that extends in a first predetermined direction that is orthogonal to a surface of said plate-shaped body portion, wherein a distance from a center of said bottom surface part to an outer edge of said first extension portion is longest of all distances from said center of said bottom surface part to outer edges of said bottom surface part, and an annular breakable part provided between a lower portion of said tip part and an upper portion of said tubular part;

wherein said first pressing portion is configured to guide a pressing force applied in said first predetermined direction when an operation of breaking said breakable part is performed.

2. The self-standing drug-filled synthetic resin ampule according to claim 1, wherein:

said bottom surface part further comprises a second extension portion that extends in a second predetermined direction that is opposite said first predetermined direction; and said tip part further comprises a second pressing portion located at least at said upper portion of said plate-shaped body portion, wherein said second pressing portion is configured to guide a pressing force applied in said second predetermined direction when an operation of breaking said breakable part is performed.

3. The self-standing drug-filled synthetic resin ampule according to claim 1, wherein said ampule body does not have a drug-storable portion in a portion above said breakable part.

4. The self-standing drug-filled synthetic resin ampule according to claim 1, wherein said bottom surface part is formed of a bottom plate member that seals a lower-end opening of said tubular body.

5. The self-standing drug-filled synthetic resin ampule according to claim 4, wherein said bottom plate member has a conical upper surface tilting toward a center of a bottom surface portion of said drug accommodation portion.

6. The self-standing drug-filled synthetic resin ampule according to claim 4, wherein said first extension portion is provided at said bottom plate member.

7. The self-standing drug-filled synthetic resin ampule according to claim 1, wherein said first extension portion is provided at a lower-end portion of said tubular body.

8. The self-standing drug-filled synthetic resin ampule according to claim 1, wherein said tubular body has an inner-surface tapered portion having a diameter that decreases toward said breakable part.

9. The self-standing drug-filled synthetic resin ampule according to claim 1, wherein the bottom surface part is formed of:

a flange portion that is located at a lower-end opening of said tubular body, and a bottom plate member that seals said lower-end opening of said tubular body and that is in contact with a lower surface of said flange portion.

10. The self-standing drug-filled synthetic resin ampule according to claim 9, wherein said extension portion is provided at said flange portion.

11. The self-standing drug-filled synthetic resin ampule according to claim 9, wherein said first extension portion is provided at said bottom plate member.

12. The self-standing drug-filled synthetic resin ampule according to claim 1, wherein said tip part comprises a circular lower end portion that is larger than said annular breakable part.

13. The self-standing drug-filled synthetic resin ampule according to claim 12, wherein said tip part comprises an inclined side portion that is inclined downwards and outwards.

14. A self-standing drug-filled synthetic resin ampule comprising:

an ampule body capable of standing by itself, wherein said ampule body comprises:

a tip part positioned at an upper part of the ampule body when the ampule body stands by itself, wherein the tip part comprises:

a plate-shaped body portion, a circular lower-end portion, and a plurality of first ribs protruding from a first surface of said plate-shaped body portion and extending between an upper end of said plate-shaped body portion and said circular lower end portion, wherein, at an upper portion of said plate-shaped body portion, each of said first ribs protrudes from said first surface of said plate-shaped body portion by substantially the same distance, and wherein a distance by which each of said first ribs protrudes increases in a downward direction between said upper portion of said plate-shaped body portion and said circular lower end portion, a tubular part comprising a drug accommodation portion that accommodates a drug, a bottom surface part that is immovably connected to the tubular part and that allows said ampule body to stand by itself, wherein said bottom surface part comprises a first extension portion that extends in a first predetermined direction that is orthogonal to a surface of said plate-shaped body portion, and an annular breakable part provided between a lower portion of said tip part and an upper portion of said tubular part.

15. The self-standing drug-filled synthetic resin ampule according to claim 14, wherein said tip part comprises:

a plurality of second ribs protruding from a second surface of said plate-shaped body portion and extending between an upper end of said plate-shaped body portion and said circular lower end portion, wherein, at an upper portion of said plate-shaped body portion, each of said second ribs protrudes from said second surface of said plate-shaped body portion by substantially the same distance, and wherein a distance by which each of said second ribs protrudes increases in a downward direction between said upper portion of said plate-shaped body portion and said circular lower end portion.

* * * * *